United States Patent [19]

Söderland

[11] 4,209,093

[45] Jun. 24, 1980

[54] CARD BOX

[75] Inventor: Bengt Söderland, Stockholm, Sweden

[73] Assignee: AB Gustavsberg, Stockholm, Sweden

[21] Appl. No.: 27,356

[22] Filed: Apr. 5, 1979

[30] Foreign Application Priority Data

Apr. 7, 1978 [SE] Sweden ..... 7803922

[51] Int. Cl.[2] ..... B65D 5/48; B65D 85/00

[52] U.S. Cl. ..... 206/425; 206/44 B; 206/561

[58] Field of Search ..... 206/425, 44 B, 561

[56] References Cited

U.S. PATENT DOCUMENTS

| | | | |
|---|---|---|---|
| 2,258,666 | 10/1941 | Walker | 206/425 |
| 2,781,125 | 2/1957 | Mills | 206/425 |

*Primary Examiner*—William T. Dixson, Jr.

*Attorney, Agent, or Firm*—Toren, McGeady and Stanger

[57] ABSTRACT

A card box for storing cards or the like includes a tray-like rectangular box member for storing cards and movable, tiltable supports which can be inserted into a series of holes or recesses provided lengthwise and widthwise along the edges of the bottom of the box. Pins at the opposite ends of the lower edges of the supports fit into the holes so that the supports can be located in differing positions lengthwise and widthwise of the box member permitting the cards to be stored lengthwise or widthwise of the box. In a preferred form, the ratio of internal length to width of the box is substantially the same as the ratio of height to width of the largest card to be stored.

6 Claims, 4 Drawing Figures

CARD BOX

SUMMARY OF THE INVENTION

The present invention relates to a card box, particularly to a card box injection moulded of thermoplastics material, for storing cards kept in place by supports tiltably mounted in the box bottom.

Known card boxes exist in different dimensions, sized to the card dimensions they are intended to hold, the European DIN standard A4, A5 and A6 sizes being predominant. DIN stands for Deutsche Industries Norm or German Industrial Standards. As the standard sizes are used vertically or horizontally, the width and length dimensions of the boxes must be made to fit the arrangement of the cards. In English speaking countries, card dimensions are still mainly given in inches or fractions of inches. Such cards are arranged vertically as well as horizontally, and each size requires a box with corresponding dimensions.

Card boxes are normally provided with one or more supports for holding the cards at an angle suitable for reading. To limit the movements of the supports for the minor card sizes, the box bottoms are provided with one or more rows of slots, or the like, into which tongues on the supports can fit. Tongues and slots are mutually shaped to give the supports the required angular disposition. In boxes for large card sizes the supports generally have tongues at their upstanding sides, which stop against the sides of the box, when the cards are turned over. Other existing card boxes have supports with borders or knobs at their sides, by means of which all supports are kept parallel to the outermost support. The length of the boxes are adapted to practical requirements for the lengthwise or widthwise arrangement of boxes in cases or containers of various sizes.

The primary object of the present invention is to provide a single box suitable for storing the most frequently used card sizes. This is achieved by arranging for the cards to be placed lengthwise as well as widthwise in the box and, accordingly, the length and width dimensions of the box have to be about the same as those of the largest card to be stored in the box. Although there are two different size standards in the West, they have much in common. Both base the card size on the most frequently used letter size, and the smaller sizes are obtained by dividing the larger one into halves. In the DIN system the ratio of the height to width is $1:\sqrt{2}$, i.e. 1:1.414. For cards sized in inches, approximate ratios are obtained as an average. Apart from the legal size (not used for cards), $8\frac{1}{2}'' \times 12''$ (standard for computer sheets) is the largest size for boxes and can be regarded as a base for the smaller size. For such a size the ratio between height and width is 1.412.

The length and width measurements of the box must exceed those of the cards in order to provide space for handling the cards and for dividers, which only slightly change the ratio between length and width.

According to the present invention, a rectangular box for storing cards or the like has movable, tiltable supports and series of holes or recesses provided lengthwise and widthwise in the bottom of the box to mate with pins on the supports to enable supports to be located in different positions lengthwise and widthwise of the box.

The various features of novelty which characterize the invention are pointed out with particularity in the claims annexed to and forming a part of this disclosure.

For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
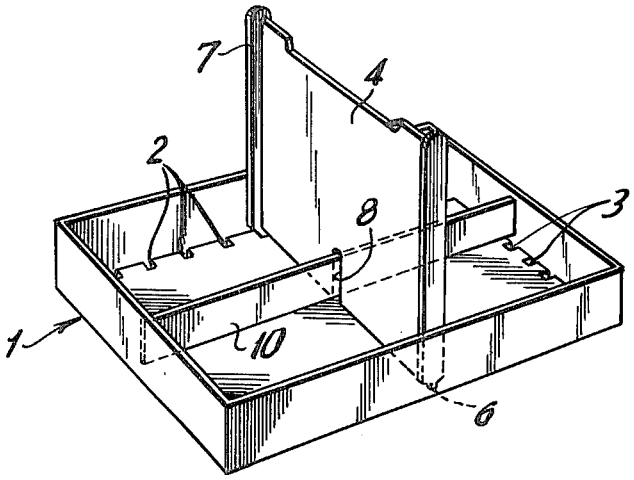
FIG. 1 shows a box arranged for cards to be supported in rows lengthwise of the box.
Figure 2:
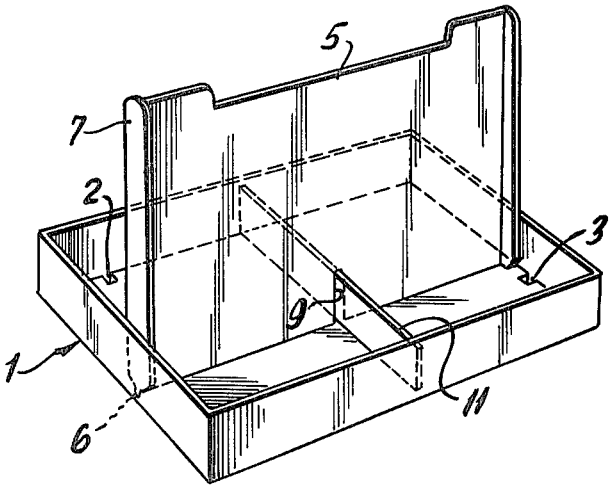
FIG. 2 shows the same box arranged for cards in widthwise rows and with a wider support for the cards.

As shown by FIGS. 1 and 2, a rectangular card box includes a tray-like box member 1 with a rectangular bottom and upwardly extending lengthwise and widthwise sides. The bottom has regularly spaced holes or recesses 2 symmetrically positioned along the lengthwise sides of the box bottom and similarly regularly spaced holes or recesses 3 symmetrically positioned along the widthwise sides of the box bottom. The holes or recesses are intended to locate card supports 4,5 by mating with pins 6 depending from the end of the lower edge of each support. The supports have flange-like side pieces 7 along their upstanding edges.

The middle of the lower edge of the supports 4,5 each have a vertical slot 8,9 to locate and support box dividers 10,11 in the form of planar strips. The slots are large enough to handle the supports to be slid along the dividers.

Figure 3:
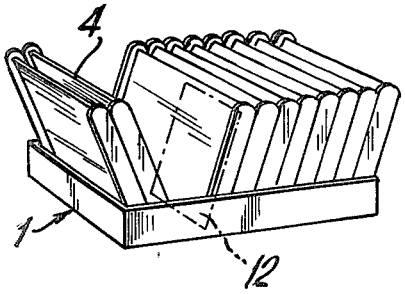
FIG. 3 shows a box complete with lengthwise located supports of A5 size, or $5'' \times 8''$.
Figure 4:
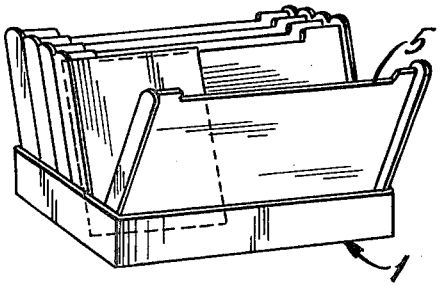
FIG. 4 shows a box complete with widthwise located supports intended for horizontally placed cards of A4 size, or $10'' \times 12''$, or, alternatively, for two rows of vertically placed A5 cards.

FIG. 3 shows a complete box with the supports 4 extending in the widthwise direction. Accordingly, the cards would be arranged in a lengthwise row with vertically arranged cards 12 of the A6 size, as shown by the dotted lines. If higher supports are used, vertically arranged cards of the A4 size could be put into the box and, if provided with lower supports, the box could be used for storing the smallest card size. The box according to FIG. 4 can be used with low lengthwise supports for two rows of cards extending in the widthwise direction and holding vertically arranged A6 size cards. If high supports are used, two rows of vertically arranged A5 size cards or one row of vertically arranged A4 cards could be accommodated. Cards of inch size can be arranged in a corresponding way.

In order to cover the main part of card sizes smaller than the DIN series, more slots 8,9 are needed in the supports 4,5 as well as more dividers 10,11; more supports of differing heights are also required.

The invention offers an advantage for the manufacture of card boxes by means of injection moulding thermoplastics material so that a card box, meeting all existing requirements, can be made in very large numbers with very few tools. Moreover, the invention gives the advantage that the user can rearrange cards, in many cases without even having to change the supports. Another advantage is that retailers and wholesalers can considerably reduce their stock quantities of card boxes.

While specific embodiments of the invention have been shown and described in detail to illustrate the application of the inventive principles, it will be understood that the invention may be embodied otherwise without departing from such principles.

What is claimed is:

1. A rectangular box adaptable for storing cards or the like of varying sizes comprises a rectangular traylike box member having a length dimension and a width dimension which is less than the length dimension, said box member having a rectangular bottom, a pair of sides extending along and upwardly from the length dimension side of said bottom, and a second pair of sides extending along and upwardly from the width dimension sides of said bottom, a series of holes formed in said bottom along each of the length dimension and width dimension sides thereof, at least one movable support having a width dimension and a height dimension with the width dimension corresponding to one of the interior length and width dimensions of said box member, said support having a lower edge extending in the width dimension direction thereof, a pin located on each end of the lower edge of said support member and said pins being removably insertable into the holes in said bottom for tiltably supporting said support therein and for selectively positioning said support within said box member, the ratio of the interior length dimension to the interior width dimension of said box member is substantially the same as the ratio of the height to width of the largest card to be stored in the box so that the box can be arranged to file cards in one or more rows with the number of rows depending on the size of the cards and with the rows extending in one of the directions of the length dimension and of the width dimension of said box member, and said holes in the bottom of said box member are uniformly spaced apart and symmetrically arranged along the length and width dimension sides of the bottom.

2. A rectangular box, as set forth in claim 1, wherein the ratio of the interior length dimension to the interior width dimension of the box member is approximately $1:\sqrt{2}$.

3. A rectangular box, as set forth in claim 1, wherein said supports each have at least one slot therein extending upwardly from said lower edge thereof with said slot being spaced from the opposite ends of said lower edge, a divider insertable into said slot and in contact with the bottom of said box member, said divider extending from said support to the sides of said box member and being disposed perpendicularly to said support member and to the sides extending in the same direction as said support member so that said divider in combination with said support divides said box member into a number of separate rectangularly shaped compartments with the dimension of the compartment extending parallel to said support member being approximately equal to one of the width and length of the card to be stored in the compartment.

4. A rectangular box, as set forth in claim 1, wherein the inside length dimension and inside width dimension of said box member is sized to correspond respectively to the height and width dimensions of a DIN standard A4 card.

5. A rectangular box, as set forth in claim 1, wherein said support has a flange extending transversely of the surface of said support along each of the edges thereof extending in the height direction of said support.

6. A rectangular box, as set forth in claim 1, wherein said box member is injection moulded of a thermoplastics material as a unitary element.

* * * * *